US010167129B2

(12) United States Patent
Brown et al.

(10) Patent No.: US 10,167,129 B2
(45) Date of Patent: Jan. 1, 2019

(54) FOOD TRAY WITH IMPROVED CONSTRUCTION

(71) Applicants: Packaging 2.0 Inc., Providence, RI (US); EasyPak LLC, Leominster, MA (US)

(72) Inventors: Michael Brown, Jamestown, RI (US); Marco Tulio Barbier, Dover, MA (US); Hector Echaniz, Brookline, MA (US)

(73) Assignees: Packaging 2.0 Inc., Providence, RI (US); EasyPak, LLC, Leominster, MA (US)

( * ) Notice: Subject to any disclaimer, the term of this patent is extended or adjusted under 35 U.S.C. 154(b) by 0 days.

(21) Appl. No.: 15/234,718

(22) Filed: Aug. 11, 2016

(65) Prior Publication Data

US 2017/0043942 A1 Feb. 16, 2017

Related U.S. Application Data

(60) Provisional application No. 62/205,095, filed on Aug. 14, 2015.

(51) Int. Cl.
*B65D 1/34* (2006.01)
*B65D 6/04* (2006.01)
(Continued)

(52) U.S. Cl.
CPC ..... *B65D 81/261* (2013.01); *B65D 1/34* (2013.01); *B65D 77/003* (2013.01)

(58) Field of Classification Search
CPC ..... B65D 81/261; B65D 77/003; B65D 1/42; B65D 1/40
(Continued)

(56) References Cited

U.S. PATENT DOCUMENTS 3,042,247 A 7/1962 Bonnet
3,409,199 A 11/1968 Lake
(Continued)

FOREIGN PATENT DOCUMENTS

EP 2540634 A1 1/2013
FR 2594421 A1 8/1987
(Continued)

OTHER PUBLICATIONS

Charter NEX Films, "The Impact of Corona Treatment on Seal Strength", 2014 Charter NEX Films, Inc., http://www.charternex.com/pages/w_corona.php.

*Primary Examiner* — Rafael Ortiz

(74) *Attorney, Agent, or Firm* — Barlow, Josephs & Holmes, Ltd.

(57) ABSTRACT

A tray is configured for supporting a product between the tray and a film extending over the tray. The tray has a bottom wall located at a lower end of the tray. The bottom wall has a peripheral edge. Side walls extend upwardly from the bottom wall. Each side wall has an upper edge at an upper end of the tray. A rim is located at the upper end of the tray, and is connected to the upper edge of the side walls. The rim extends horizontally outwardly from the upper edge of the side walls. A skirt depends downwardly from the rim, and is spaced outwardly from the side walls. The skirt is configured so the skirt can be bent inwardly when a film is held in tension around the skirt of the tray.

9 Claims, 9 Drawing Sheets

(51) Int. Cl.
*B65D 81/26* (2006.01)
*B65D 77/00* (2006.01)

(58) Field of Classification Search
USPC ..... 206/557, 497; 53/461; 220/495.01, 220/495.03
See application file for complete search history.

(56) References Cited

U.S. PATENT DOCUMENTS

| | | | | |
|---|---|---|---|---|
| 3,450,326 | A | 6/1969 | Foote | |
| 3,863,833 | A * | 2/1975 | Swett | A47J 47/02 206/557 |
| 4,291,616 | A | 9/1981 | Taylor | |
| D270,703 | S | 9/1983 | El-Hag et al. | |
| 4,874,083 | A * | 10/1989 | Antoni | B65D 1/36 206/557 |
| 5,018,623 | A * | 5/1991 | Hrenyo | B65D 1/34 206/497 |
| D360,767 | S | 8/1995 | Fish et al. | |
| 5,833,894 | A | 11/1998 | Lanzani et al. | |
| 5,891,387 | A | 4/1999 | Rolle | |
| D432,355 | S | 10/2000 | Bouldstridge | |
| 6,149,053 | A | 11/2000 | Chatterton et al. | |
| 6,216,855 | B1 | 4/2001 | Grone | |
| 6,279,738 | B1 | 8/2001 | Mungo et al. | |
| RE37,780 | E | 7/2002 | Lanzani et al. | |
| D514,765 | S | 2/2006 | Dretzka | |
| D553,859 | S | 10/2007 | Fernandez et al. | |
| D553,860 | S | 10/2007 | Fernandez et al. | |
| D562,589 | S | 2/2008 | Mellon | |
| D581,726 | S | 12/2008 | Shamoon | |
| D617,522 | S | 6/2010 | Teien | |
| D631,104 | S | 1/2011 | With | |
| D667,681 | S | 9/2012 | Carsten | |
| D675,259 | S | 1/2013 | Chang | |
| D682,634 | S | 5/2013 | Datavs | |
| D689,327 | S | 9/2013 | Ortegon et al. | |
| D689,741 | S | 9/2013 | Wang | |
| D699,524 | S | 2/2014 | Hasegawa | |
| 8,716,638 | B2 | 5/2014 | Tuszkiewicz et al. | |
| 2003/0170352 | A1 * | 9/2003 | Owen | B65D 77/003 426/129 |
| 2013/0098800 | A1 * | 4/2013 | Rehmanji | B65D 1/34 206/557 |
| 2015/0001127 | A1 * | 1/2015 | Nelson | B29C 51/266 206/557 |

FOREIGN PATENT DOCUMENTS

| | | | |
|---|---|---|---|
| FR | 2599002 | A1 | 11/1987 |
| FR | 2799434 | A1 | 4/2001 |
| WO | 2011083342 | A2 | 7/2011 |

* cited by examiner

FOOD TRAY WITH IMPROVED CONSTRUCTION

CROSS REFERENCE TO RELATED APPLICATION

This application is related to and claims priority from earlier filed provisional patent application Ser. No. 62/205,095, filed Aug. 14, 2015, the entire contents thereof is incorporated herein by reference.

BACKGROUND OF THE INVENTION

The present invention relates to generally to trays. More specifically, the present invention relates to a thermoformed container for food packaging, such as containers for holding meat.

Prior art trays for supporting and holding food such as meat are very well known. They typically include soft foam trays that are neither recyclable nor made from recyclable material. These prior art trays are harmful for the environment. The food is placed on the top of the soft foam tray and then a protective film is secured about the tray to secure the food therein. For example, the film is typically a clear plastic (cling) wrap so a customer may easily see the food on the tray. The film is commonly either manually stretched over the tray with the food therein and wrapped tight to seal the food therein. Also, automated film wrapping is also possible. In sum, it is desirable for the film to be tightly secured about the tray to seal in the food for longer shelf life.

The act of wrapping film about a food tray may result in tearing of the protective film. Prior art trays can have sharp edges so, when film is wrapped thereabout, that film can easily torn or ripped thereby destroying the integrity of the seal of the resultant tray and film container about the food.

Therefore, there is a need for a food tray and food tray construction that can better receive sealing film so tearing of that film is avoided to provide a better overall storage container package for the food for longer shelf life.

SUMMARY OF THE INVENTION

The instant invention provides a food tray for storing products thereon. The food tray is configured for use with a film, such as plastic film, that extends above the upper surface of the tray and the product stored on the tray. For example, the food tray is useful for packaging raw meat, with the meat placed on the tray, and a film extending over the meat and about the tray.

Generally, the food tray has a bottom wall that is located at a lower end of the tray. A plurality of side walls extends upwardly from the bottom wall, and are located at and connected to the peripheral edge of the bottom wall. Each side wall has a lower edge that is connected to the bottom wall, and each side wall has an upper edge at the upper end of the tray to thereby provide a tray-like construction with an open upper end.

A rim is located at the periphery of the open upper end of the tray, and is connected to the upper edge of the side walls at the inner peripheral edge of the rim. The rim extends generally horizontally outwardly from the inner peripheral edge of the rim, and generally horizontally outwardly from the upper edges of the respective side walls.

A flexible skirt depends downwardly from the rim adjacent to the outer peripheral edge of the rim, and the skirt is spaced outwardly from the side walls to permit a range of deflection for flexibility.

The tray of the present invention is useful for supporting a product thereon and for cooperating with a film to contain the product between the tray and the film to provide a sealed container package. In particular, the rim and the skirt of the tray provide a tray construction that is devoid of a structure, in the form of an edge, such as one that is sharp or thin, that could engage the sealing film in a way that would damage the film, such as causing the film to rip, cut or tear. The rim extends from the upper ends of the side walls so there is no sharp edge at the upper end of the side walls, and the skirt depends downwardly adjacent to the outer periphery of the rim so there is no sharp edge at the outer periphery of the rim. The skirt depends downwardly to a sufficient extent that tension applied to the film tends to bend the lower edge of the skirt inwardly, rather than to provide a sharp edge, which would cause an undesirable tear or cut to form in the film where the film engages the lower edge of the skirt.

In addition, the exemplary embodiment of the tray further includes a groove in the form of a stepped wall at the outer peripheral edge of the rim to cooperate with the flexible skirt to further avoid damage to the sealing film. The stepped wall has an upper step surface that extends horizontally, and that is spaced vertically below the rim. The upper edge of the skirt is connected to the stepped wall. This stepped wall forms a groove between the outer peripheral edge of the rim and the upper edge of the skirt. The outer groove further reduces the likelihood of a tear forming in the film by providing a further smoother transition of the connection of the rim to the skirt, namely by providing an angled transition support with an air gap/groove to avoid excess contact with the film, which also may cause damage to the film. Moreover, the film engages the corner surface where the vertical wall of the outer groove meets the rim, as well as the corner surface where the stepped wall of the outer groove meets the skirt. The film is supported by these two convex corners so there is less chance of a tear forming in the film, and the film can slide over the groove.

To reinforce the tray of the exemplary embodiment, a plurality of ribs is provided in the side walls and the bottom wall of the tray. The ribs, provide structural reinforcement to the tray so the tray can be made of a thinner material to reduce costs and to be more environmentally friendly. In accordance with the present invention, the ribs can further support the film when the film is secured about the tray and food and further assist in the transition of the film from the upper peripheral edge to the bottom of the tray.

The skirt extends downwardly and outwardly with respect to the rim, and extends about the outer peripheral edge of the rim. The skirt is made of a flexible material that allows the skirt to be bent inwardly, so the lower edge of the skirt is displaced inwardly by a film held in tension around the skirt. The tray and skirt are preferably formed, such a by thermoforming, from the same material at the same time. In the exemplary embodiment, the lower edge of the skirt is located closer to the lower end of the tray than it is to the upper end of the tray.

Accordingly, among the objects of the instant invention are: the provision of a tray that is configured for storing a product between the tray and a film extending over the tray; the provision of a tray that has a reduced tendency to tear a film extending in tension over the tray; the provision of a tray that allows for extended shelf life of a perishable food product on a shelf in a store; the provision of a tray that reduces the need for repackaging a product on the tray; the provision of a tray that reduces the tendency of the tray to tear a film due to formations in the tray from the manufacturing process; the provision of a tray that is recyclable and/or made of recycled material; and the provision of a tray that has a bottom wall that is configured to retain fluid on the upper surface of the bottom wall. Other objects, features and advantages of the invention shall become apparent as the description thereof proceeds when considered in connection with the accompanying illustrative drawings.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

DESCRIPTION OF THE INVENTION

Figure 1:
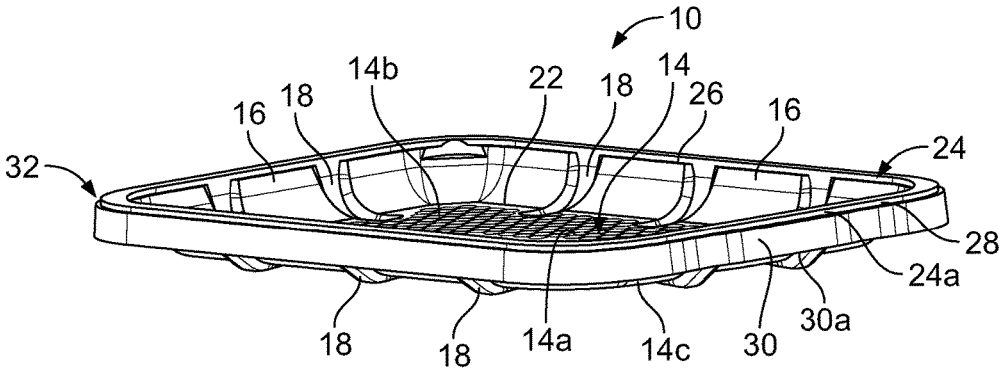
FIG. 1 is a perspective view of an exemplary embodiment of the tray of the present invention.

Referring now to the drawings, the tray 10 of the instant invention is illustrated in detail. As will hereinafter be more fully described, the tray 10 construction of the present invention is useful for supporting a product, such as food 12 (shown in FIG. 9), in an enclosed region defined by the upper surface of the bottom floor 14 of the tray 10, the inner surfaces of the side walls 16 of the tray, with integral ribs 18 formed in the bottom floor 14 and the side walls 16, and the lower surface of a film 20 extending over the tray 10.

The tray 10 of the present invention is particularly useful for storing food 12, such as meat, thereon. The tray 10 is well-suited to receive a film 20 cover for sealing the food 12 to preserve and extend shelf life. The film 20 can be either manually stretched over the tray 10 or installed by automated equipment while avoiding the film 20 from being ripped, torn or otherwise damaged.

Turning now to the figures, FIGS. 1-6B show views of an exemplary embodiment of the tray 10 of the present invention. FIG. 1 shows a perspective view of an exemplary embodiment of the tray 10 after it has been manufactured, but before it has been used to support a product 12 therein, and before a film 20 has been extended over and about the tray 10. The tray 10 has a bottom floor 14 that is located at a lower end of the tray 10. The bottom floor 14 has a peripheral edge 22 around an upper surface 14*a* of the bottom floor 14. The upper surface 14*a* of the bottom floor 14 is useful for supporting a product 12, such as food.

The upper surface 14*a* of the bottom floor 14 of the exemplary embodiment has a dimpled pattern 14*b* defined thereon. The dimples 14*b* are preferably in the form of recesses, which are useful for retaining liquid droplets within the recesses defined by the dimples, as will be described in detail below. In other embodiments, the upper surface 14*b* of the bottom floor 14 is flat and featureless, or at least substantially flat and substantially featureless.

A plurality of side walls 16 extends upwardly from the bottom floor 14 and is located at the peripheral edge 22 of the bottom floor 14. The connection between the side walls 16 curve inwardly at their lower edges to meet the bottom floor 14. Each side wall 16 has a lower edge that is connected to the bottom floor 14, each side wall 16 having an upper edge at an upper open end of the tray 10. Each pair of adjacent side walls 16 meet at a respective corner portion that extends upwardly from the bottom floor 14 towards a rim 24.

In the exemplary embodiment, there are four side walls 16 extending upwardly from the bottom floor 14. The four side walls 16 of the exemplary embodiment are integrally formed with the bottom floor 14. Similarly, there are four corner portions in the exemplary embodiment.

Figure 2:
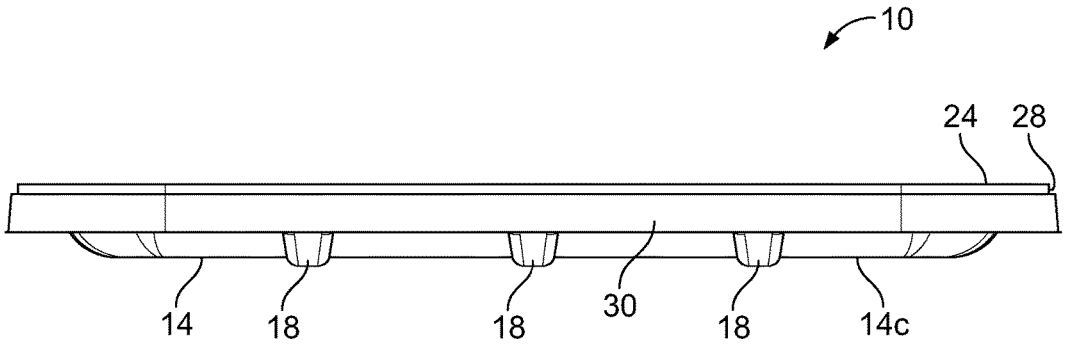
FIG. 2 is a side view thereof.
Figure 3:
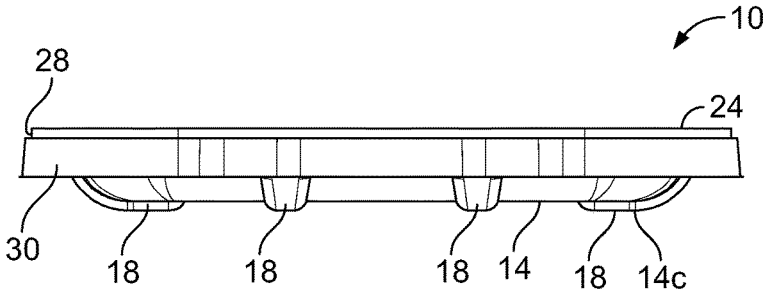
FIG. 3 is an end view thereof.

The rim 24 is located at the upper end of the tray 10. The rim 24 is connected to the upper edges of the side walls 16 at an inner peripheral rim edge. The rim 24 has an upper rim surface 24*a* that extends horizontally outwardly from the upper edge of each respective side wall 16. The rim 24 of the exemplary embodiment is integrally formed with the side walls 16. The upper surface 24*a* of the rim 24 is flat or at least substantially flat, as best seen in FIGS. 2 and 3, but also may be of other configurations, such as rounded (not shown).

The embodiment of FIGS. 1-6B includes two grooves 26, 28 formed along the rim. There is a first groove 26, an inner peripheral groove, formed along the inner peripheral edge of the rim 24, connecting the upper rim surface to the side walls. There is a second groove 28, an outer peripheral groove, formed along the outer peripheral edge of the rim 24, connecting the upper rim surface to a skirt 30. The two grooves 26, 28 reinforce the rim 24 so that it has increased rigidity. For example, because of the grooves 26, 28, the rim 24 has greater bending resistance in response to loads applied to the rim 24. As will be described below, the outer peripheral groove 28 assists in the transition of the film 20 from the rim 24 to the bottom of the tray 10 to avoid damage of the film 20.

The skirt 30 depends downwardly from the rim 24, adjacent to the outer peripheral edge of the rim 24. The skirt 30 is spaced outwardly from the side walls 16. The outer peripheral groove 28 formed on the rim 24 is a stepped structure 32 formed at the outer peripheral rim edge. The stepped structure 32 has an upper step surface extending horizontally. The upper edge of the skirt 30 is connected to the stepped structure 32 and depends downwardly from the stepped structure 32. The stepped structure 32 is connected to a vertical wall that is connected to the horizontal upper rim surface 24*a*.

The present invention provides a tray 10 that is useful for cooperating with a film 20 stretched over the tray 10 to retain a product 12 between the tray 10 and the film 20. In particular, the skirt 30 and the stepped wall structure 32 of the outer peripheral groove of the rim 24 decreases the tendency of the tray 10 to cause damage to the film 20.

Figure 7A:
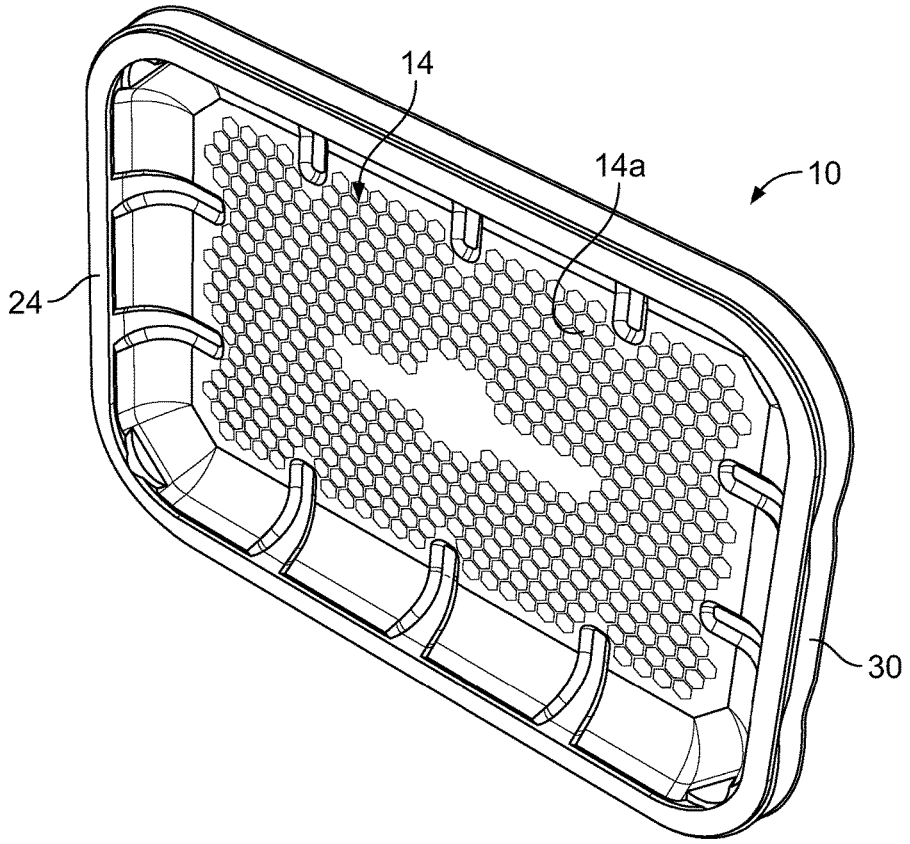
FIGS. 7A-D show dimensions of a second embodiment of the tray of the present invention.
Figure 7B:
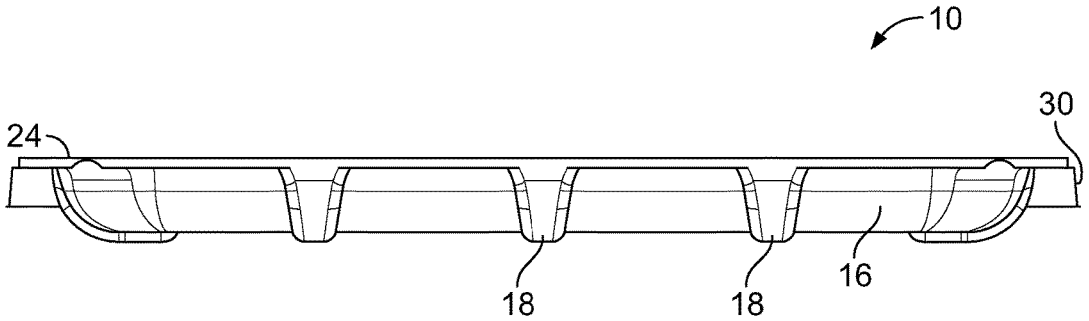
Figure 7C:
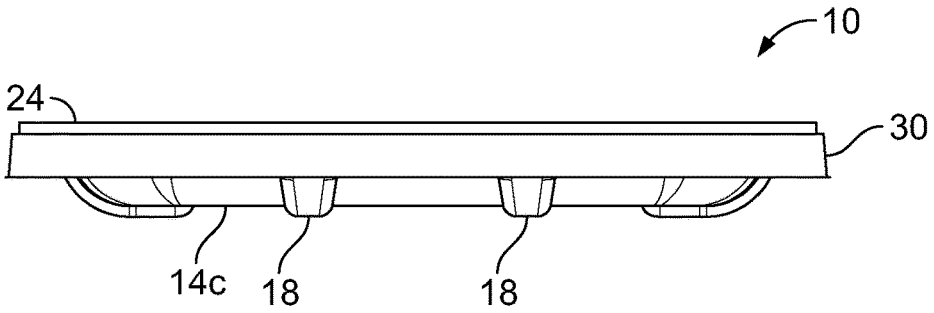
Figure 7D:
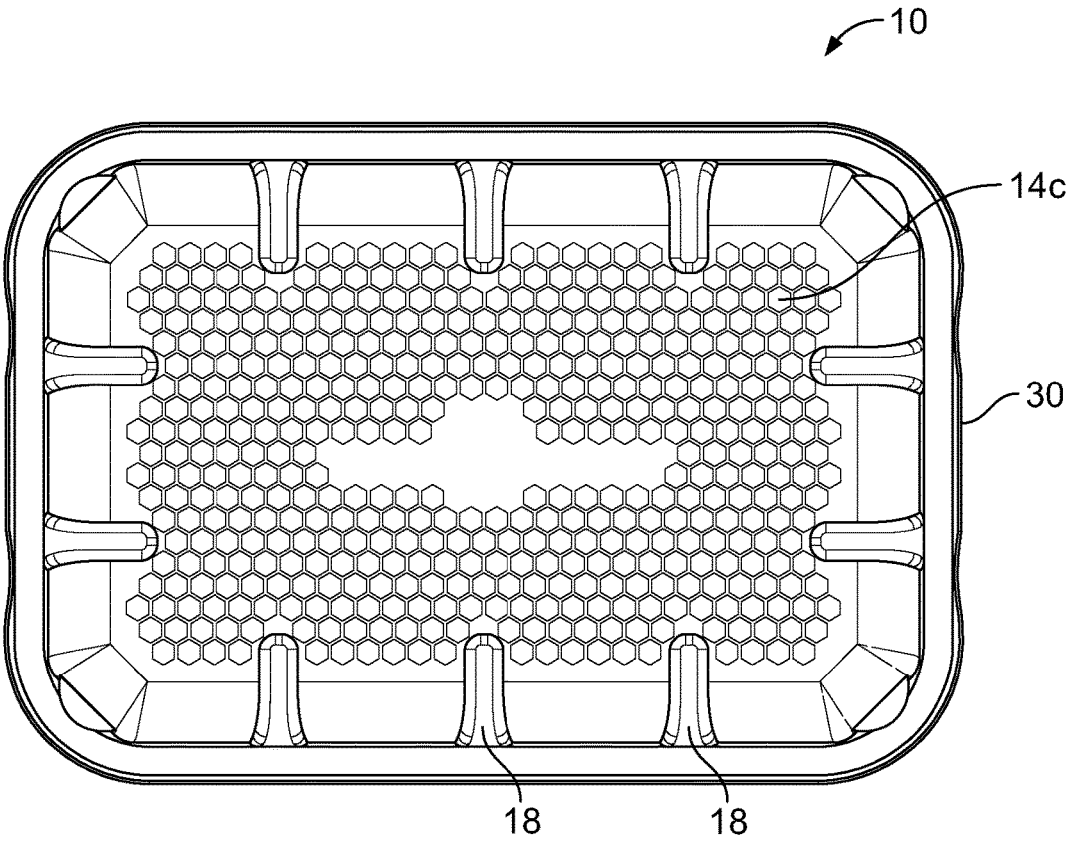

First, regarding the skirt 30, the lower edge 30*a* of the skirt 30 is located closer to the lower end or bottom 14*c* of the tray 10 than to the upper end of the tray 10 at rim 24. Because of the material choice of the skirt 30, the thickness of the skirt 30, and the height of the skirt 30, the lower edge 30*a* of the skirt 30 can be desirably deflected inwardly by the tension on the film 20. FIGS. 7A-7D show sample dimensions of a tray 10 of the present invention. FIG. 7B shows the distance from the lower edge 30*a* of the skirt 30 to the upper surface of the stepped wall at the rim 24 of the outer groove can be 0.310 inches in the vertical direction, and the distance from the horizontal stepped wall structure 32 of the outer groove 28 to the rim surface can be 0.063 inches in the vertical direction. FIG. 7B also shows that the distance from the lower surface of the bottom floor 14*c* to the upper surface of the stepped structure 32 of the outer groove 28 is 0.500 inches in the vertical direction. The total height of the tray 10 is shown in FIG. 7C as 0.64 inches in the vertical direction. The overall width of the tray 10 is 5.750 inches and the overall length of the tray 10 is 8.250 inches. In particular, the height of the skirt 30 allows the skirt 30 to be more easily deflected inwardly when a film 20 is held in tension around the skirt 30. It should be noted that the above dimensions are examples only; the tray of the present invention can be made of any dimensions and any configuration and still carry out the present invention.

Figure 6A:
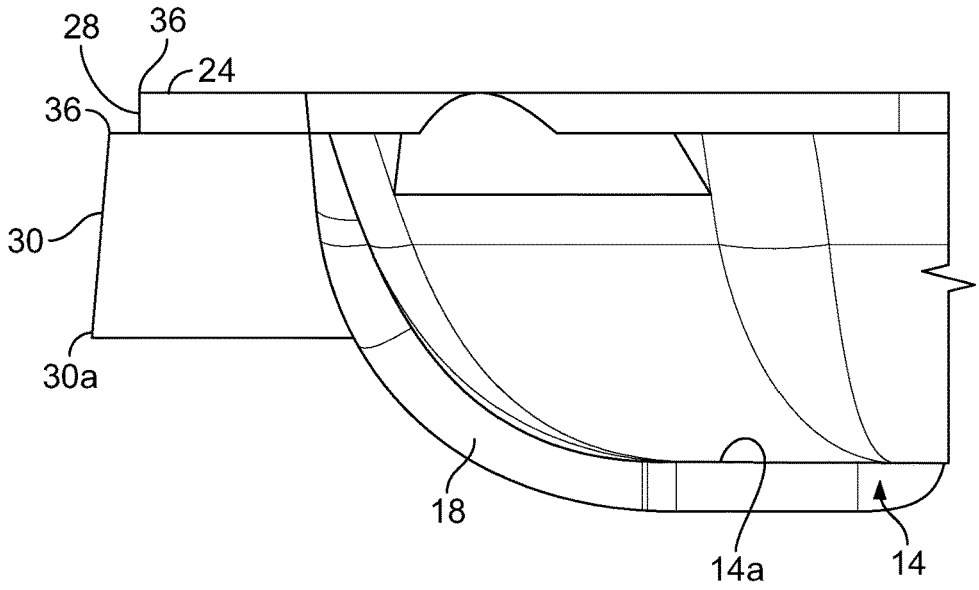
FIG. 6A shows a partial cross-sectional view of the skirt in an unloaded state through the line 6A-6A of FIG. 4.

When an external load is not applied to the skirt 30, the skirt 30 extends downwardly and outwardly from the rim 24 about the outer peripheral edge of rim 24. The free, unloaded state of the skirt 30 is shown in FIG. 6A, which is a sectional view of the embodiment of FIG. 4.

Figure 6B:
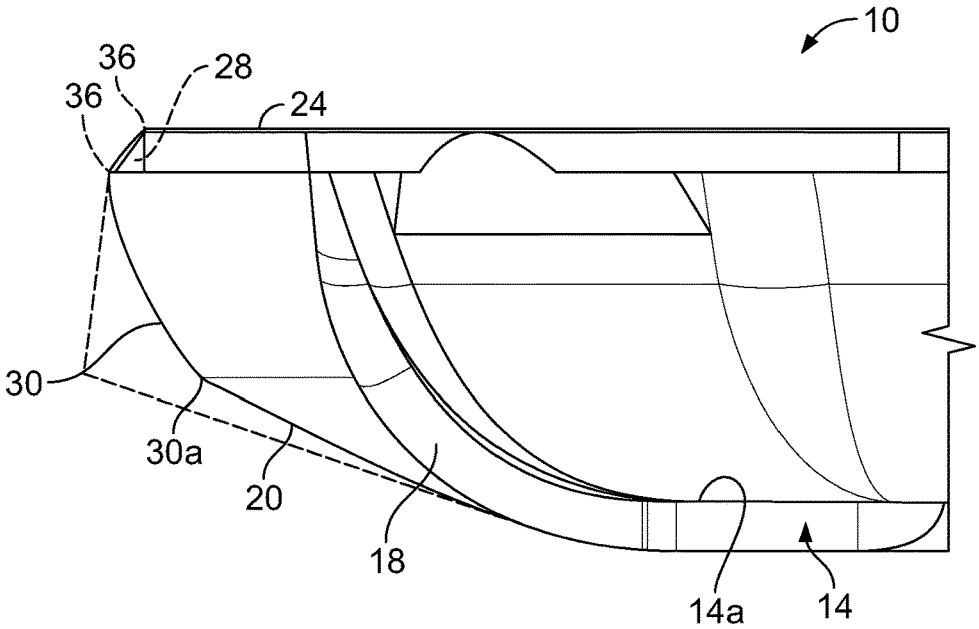
FIG. 6B shows the skirt of FIG. 6A in which a film is held in tension against the skirt with the skirt in a tensioned/flexed state.

The deflectable skirt 30 is made of a flexible material that allows a lower edge 30*a* of the skirt 30 to be deflected inwardly. When a film 20 is held in tension around the tray 10 of the present invention, the film 20 bends the skirt 30 inwardly, towards the side walls 16. Such tension is caused by the stretching of film 20, manually or by automated equipment, over and about the tray 10 with food 12 thereon. FIG. 6B shows an example of how the skirt 30 can be deflected inwardly to a loaded state shown in solid lines (from an unloaded state shown in broken lines).

In another embodiment, the skirt 30 can be dimensioned such that the lower edge 30*a* of the skirt 30 can touch the respective outer surfaces 18*a* of one or more ribs 18 when the skirt 30 is deflected inwardly. In such an embodiment, the film 20 is held in tension to deflect the skirt 30 inwardly, and the outer rib surfaces 18*a* help support the skirt 30. Beyond the region of the skirt 30, the ribs 18 support the film 20. The ribs 18 and the skirt 30 support the film 20 to further reduce the risk of the film 20 tearing during handling by consumers when the film 20 is held in tension around and about the tray 10.

Figure 8:
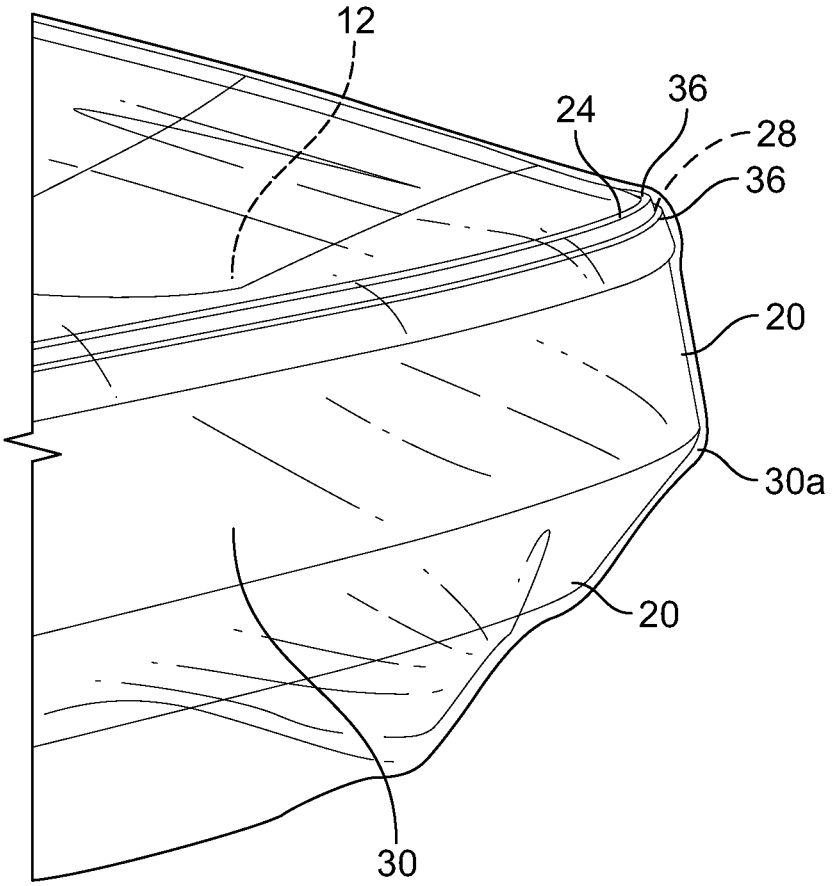
FIG. 8 shows a side perspective view of the tray construction of the present invention with film secured to the tray with food stored therein.
Figure 10:
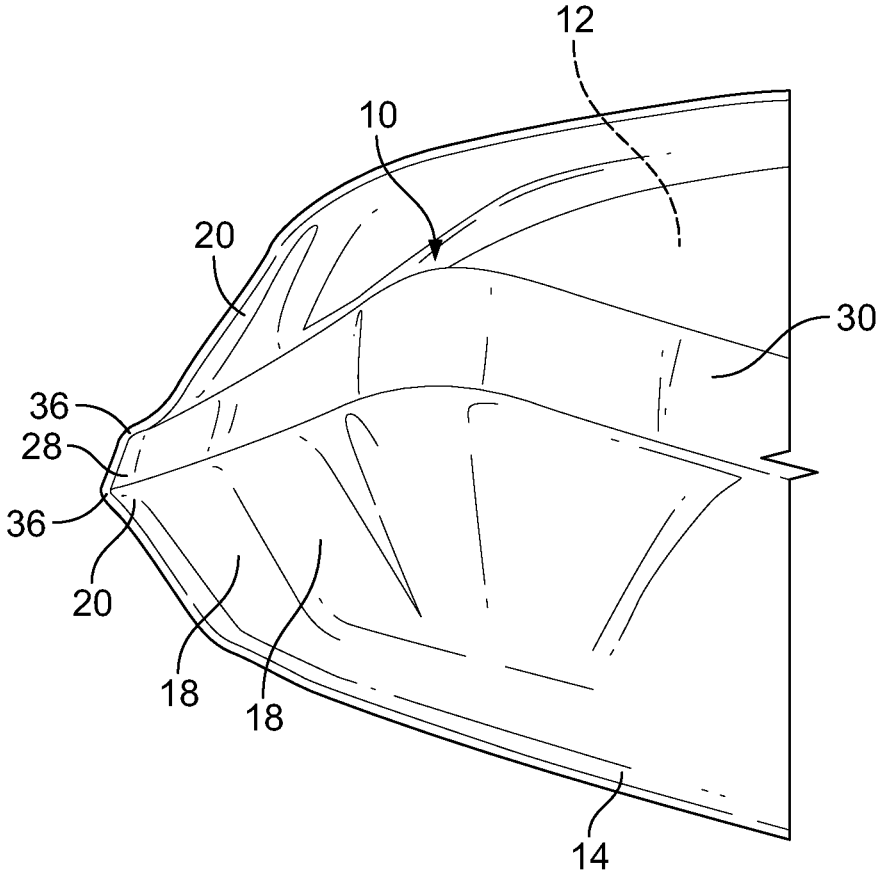
FIG. 10 is a close-up side view of the tray construction of the present invention illustrating the film being further supported by the ribs.
Figure 11:
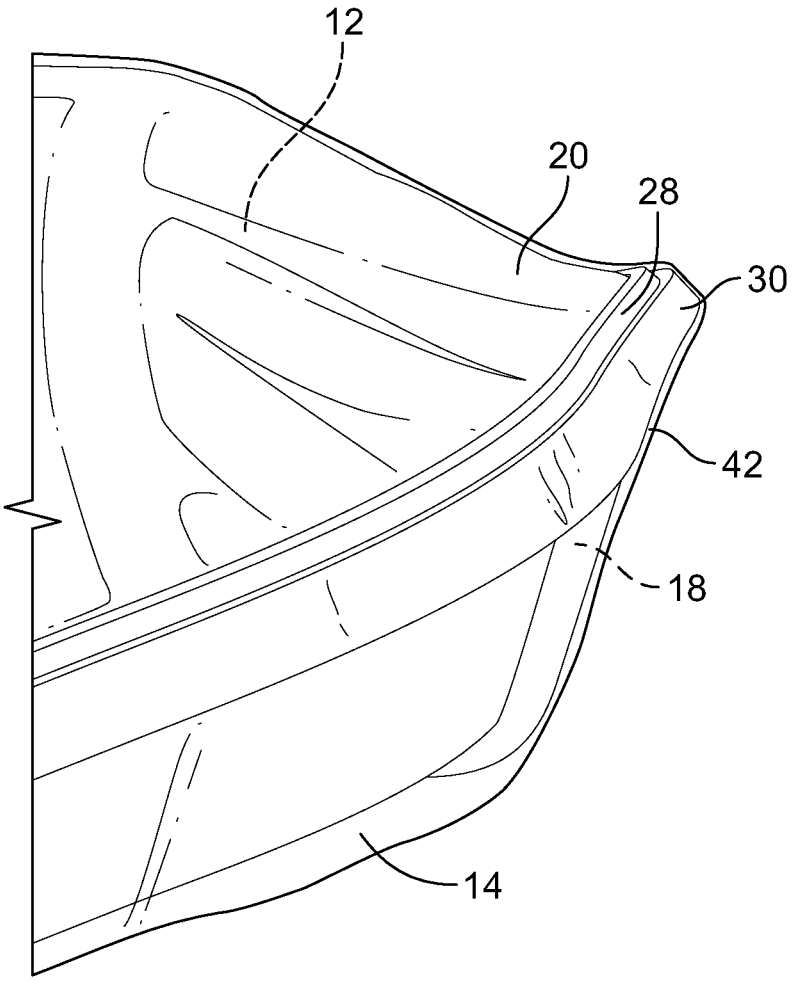
FIG. 11 is a further side view of the tray construction of the present invention showing the skirt in a flexed loaded state while avoiding tearing or ripping of the film.

Second, the outer peripheral groove 28 facilitates sliding of the film 20 over the rim 24. As shown in FIG. 6B, the film 20 contacts the outer peripheral groove 28 at the two external convex corners 36 of the groove 28 along the outer peripheral edge of rim 24 at the upper end of the tray 10. When the film 20 is held in tension around the tray 10, the film 20 resides over the groove 28 and the air gap created by the groove 28 as defined by the two convex corners 36. This decreases the friction between the film 20 and the tray 10, allowing the film 20 to slide more easily over the tray 10 in the region of groove 28. FIGS. 8, 10 and 11 show such a tray 10 with the sealing film 20 tensioned over and about the tray 10 to provide a desirable sealed food package.

To further decrease the likelihood of a tear forming in a film 20 that is held in tension around the tray 10, depressions are formed on the edges of the tray 10 in the skirt 30 where the nicks 40 from the manufacturing process are located. It is well known in the art of thermoforming that there must be some type of web member to connect to the article being formed during the manufacturing process. Those connective web members are cut from the article form leaving sharp structures in the form of nicks 40. These sharp nicks 40 can easily damage sealing film 20 when it is stretching over that portion of the tray article 10.

Figure 4:
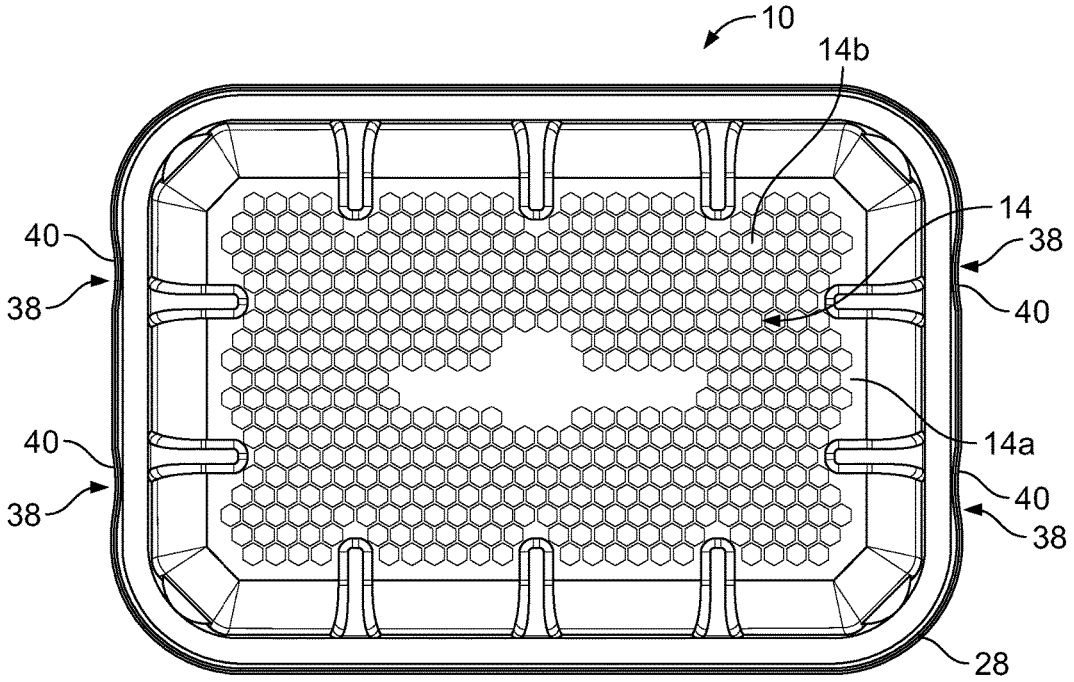
FIG. 4 is a top view thereof.

The present invention addresses these nicks 40 so they are isolated from the stretched sealing film 20. FIG. 4 shows at least, such as two, depressions 38 formed on opposite ends of the tray 10, in the skirt 30. The number of depressions can correspond to the number of nicks 40 left remaining on the tray 10 so that all nicks 40 are isolated from film 20. In the regions of the depressions 38, the skirt 30 does not extend as far outwardly from the center of the tray 10 as in adjacent regions of the skirt 30. In thermoforming, for example, the nicks 40 (sharp protrusions) can remain on edges of the finished product where material was previously connected to another part or another portion of material before the final manufacturing step. These nicks 40 and other material connecting the tray 10 to the material web (not shown) enables the tray 10 to travel down the manufacturing line while remaining connected to the web, which is helpful for manufacturing. The formed tray 10 is later broken away from the web by breaking a small number of connectors that were the result of nicks 40 in a mold (not shown). The tray 10 is disconnected from the web at these nick locations 40 leaving a small burr that can cause the overwrap sealing film 20 to rip, which is undesirable. The present invention recesses the nick 40, in the form of a burr, so that it is recessed a distance away from the overwrap film 20. The nick 40 is located on the surface of the respective depression in the skirt 30. When the film 20 extends over the skirt 30, there is a gap 42 formed between the film 20 and the depression surface, so the nick 40 does not contact the film 20, as can be seen in FIG. 11. This greatly reduces the ability for the nick 40 to damage the sealing film 20.

In the exemplary embodiment, a plurality of ribs 18 is defined in the side walls 16 and the bottom floor 14. The ribs 18 extend generally downwardly and outwardly from the side walls 16 and bottom floor to define recesses in the side walls 16 and bottom floor 14, respectively. The recesses defined by the ribs 18 increase the internal volume defined by the geometry of the tray 10. The ribs 18 also increase the rigidity of the tray 10, so that it has greater bending resistance in response to bending loads.

The ribs 18 defined in the tray 10 help to support the film 20. FIG. 6B shows the film 20 stretched over the tray 10, and the film 10 extending over the surface of the ribs 18, rather than being in contact with the entire bottom surface 14 of the tray 10.

In other embodiments not shown, the ribs 18 are defined only in the side walls 16. In still other embodiments not shown, the ribs 18 are defined only in the bottom wall 16. The ribs 18 of embodiments not shown can be defined in the bottom floor 14, extending laterally, longitudinally, or at an angle to the lateral and longitudinal directions.

The tray 10 of the present invention allows for extended shelf life of products 12 contained within the tray. Store displays of products 12 contained within the trays would require fewer teardowns because the products last longer (e.g. food is less likely to spoil), and the films 20 on the trays 10 are less likely to tear because it is more supported by the skirt 30.

The tray 10 of the present invention can be formed by thermoforming, vacuum forming, pressure forming, injection molding, or another method.

The tray 10 of the exemplary embodiment is formed from Polyethylene terephthalate (PETE). In other embodiments, other materials, or combinations of PETE and other materials, or combinations of other materials may be used. It is possible to use materials that are recyclable and/or recycled.

Figure 5:
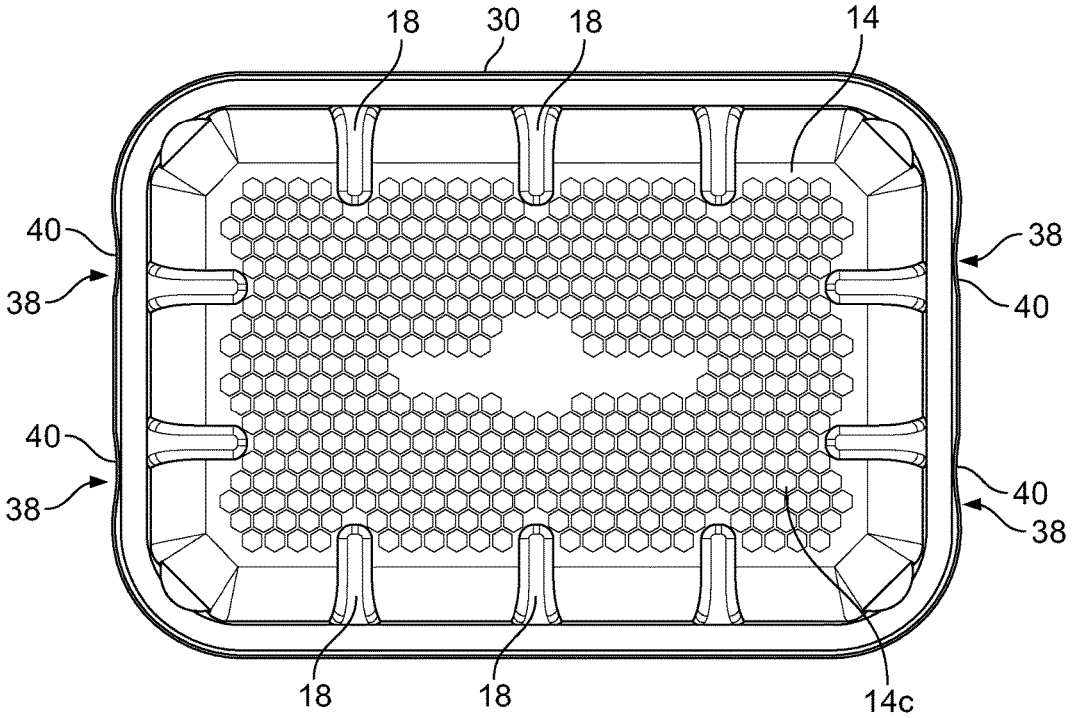
FIG. 5 is a bottom view thereof.

As mentioned above, the upper surface 14*a* of the bottom floor 14 can include a dimpled pattern 14*b* of an array of fluid recesses. In particular, these dimples or recesses 14*b* are formed as, for example, as a honeycomb aperture array in the exemplary embodiment to facilitate fluid retention on the upper surface 14*a* of the bottom floor 14. FIGS. 4 and 5 show a dimpled honeycomb pattern 14*b* formed in the bottom floor 14. Each of the dimples (or honeycomb structures) of the exemplary embodiment has six side walls so that each honeycomb structure is hexagonal or at least substantially hexagonal when viewed from the top or bottom. Other shapes recesses can be employed. The honeycomb structures each have a bottom wall connected to the side walls at the lower end of the respective side walls so that each honeycomb structure is useful for retaining a liquid, such as meat juices, within the respective honeycomb structure 14*b*. Each honeycomb structure has an open upper end for receiving a liquid therein. As a result, the tray 10 of the present invention does not need an absorbent pad inserted under products such as meat 12, which is typically used for soaking up meat juices. The tray 10 includes a floor 14 that has the integrated honeycomb pattern 14*b* described above that holds, for example, about ¼ oz. of liquid, which minimizes need for or avoids the use of the absorbent pads. Because the honeycomb pattern can retain liquid, liquid is less likely to leak from the tray of the present invention when the user removes the film 20 from the tray 10 or if a user otherwise forms a hole in the tray 10 or the film 20. Due to the surface tension of liquids, such as meat juices and water, liquid will stay trapped in the honeycomb structures 14*b*, even if the tray is held completely upside down. The liquid (now shown) can be released from the honeycomb structure (if needed) if it is turned upside down and then struck lightly on a surface.

Figure 9:
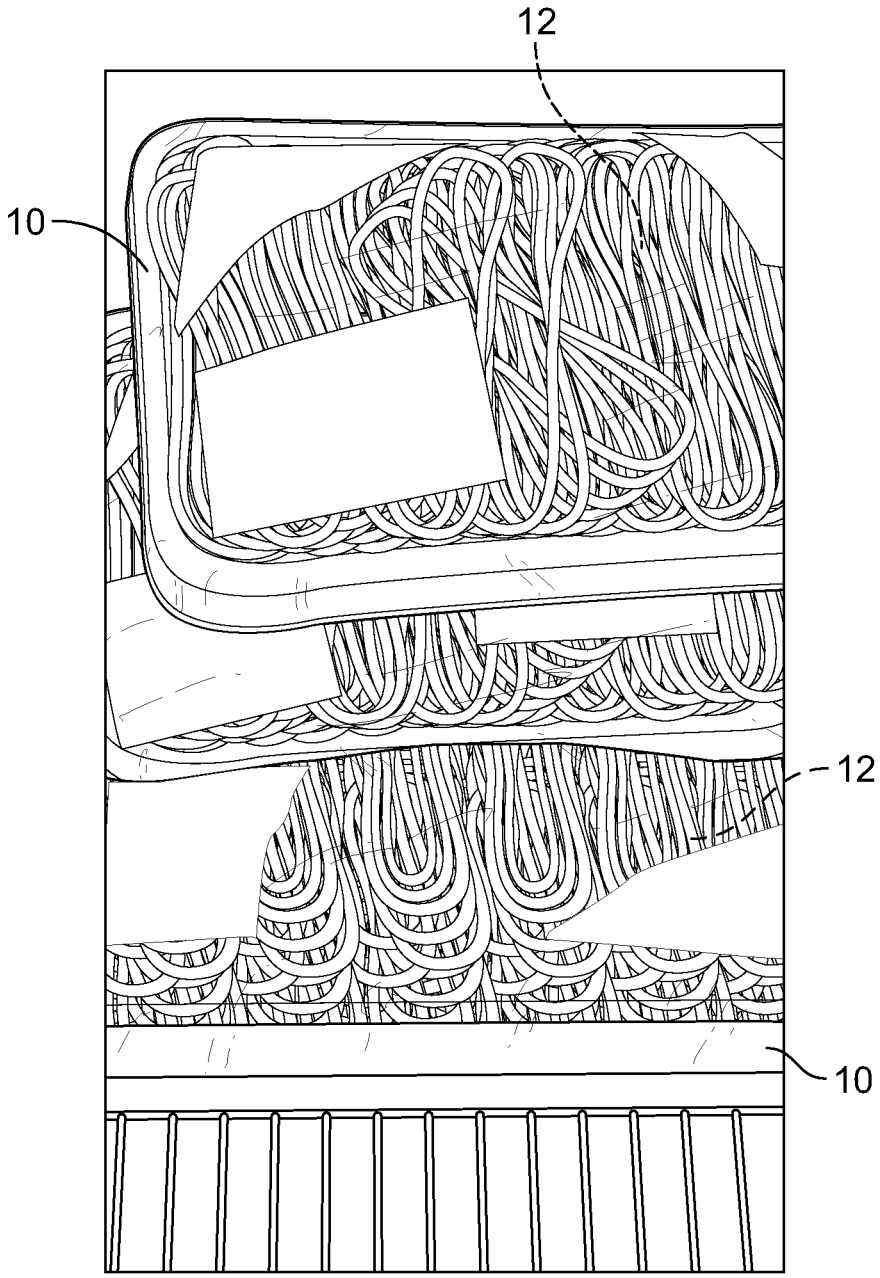
FIG. 9 is a front perspective view of a number of food trays of the present invention, with food secured therein, in a stacked arrangement.

It can therefore be seen that the food tray 10 of the present invention 20 provides a tray 10 that is configured for storing a product 12 between the tray 10 and a film extending over the tray, such as in FIGS. 8, 10 and 11; provides a tray 10 that has a reduced tendency to tear a film 20 extending in tension over the tray 10; provides a tray 10 that allows for extended shelf life of a perishable food product 12 on a shelf in a store, such as FIG. 9; provides a tray 10 that reduces the need for repackaging a product on the tray 10; provides a tray 10 that reduces the tendency of the tray 10 to tear a film 20 due to formations in the tray 10 from the manufacturing process; provides a tray 10 that is recyclable and/or made of recycled material; and provides a tray 10 that has a bottom floor 14 that is configured to retain fluid on the upper surface 14*a* of the bottom floor 14. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tray construction, comprising:

a tray having a bottom wall located at a lower end of thereof, the bottom wall having a peripheral edge;

a plurality of side walls extending upwardly from the bottom wall and located at the peripheral edge of the bottom wall, each side wall having a lower edge connected to the bottom wall, each side wall having an upper edge at an upper end of the tray;

a rim located at the upper end of the tray, the rim connected to the upper edge of the side walls at a peripheral rim edge, the rim extending outwardly from the upper edge of each respective side wall;

a skirt depending downwardly from the rim adjacent to an outer peripheral rim edge, the skirt having a lower edge and being spaced outwardly from the side walls; the skirt being movable between a first resting position and a second flexed position;

a flexible wrap film residing about the upper edge and upper end of the tray extending downward towards, and over, the peripheral rim edge to the bottom of the tray, the film moving the skirt from the first resting position to the second flexed position; the film being controllably positioned, when the skirt is in the flexed position, to avoid tearing thereof, and a plurality of ribs defined in at least one of: the side walls and the bottom wall; the plurality of ribs support the film at the transition from the peripheral rim edge to the bottom of the tray to avoid tearing thereof, wherein the peripheral rim edge of the tray includes a stepped wall defining a groove, the stepped wall being oriented and extending horizontally, and wherein the skirt includes an uppermost edge, the upper most edge of the skirt extends downward from the stepped wall.

2. The tray construction of claim 1, wherein a lower edge of the skirt is located closer to the lower end of the tray than to the upper end of the tray.

3. The tray construction of claim 1, wherein the skirt extends downwardly and outwardly from the rim about the outer peripheral rim edge, wherein the skirt is made of a flexible material that allows a lower end of the skirt to be deflected inwardly.

4. The tray construction of claim 1, wherein a top surface of the bottom of the tray defines a plurality of recesses configured and arranged to retain liquid therein.

5. The tray construction of claim 1, wherein the lower edge of the skirt includes a plurality of recesses with connective nicks, resulting from thermoforming of the tray, residing therein in recessed location to thereby be in spaced apart relation from the film when residing about the tray to thereby avoid tearing of the film.

6. The tray construction of claim 1, wherein the film covers an entirety of the tray.

7. the tray construction of claim 4, wherein the plurality of recesses each have a hexagonal shape and are arranged in a honeycomb pattern.

8. The tray construction of claim 1, wherein the tray is formed from polyethylene terephthalate.

9. The tray construction of claim 1, wherein the flexible wrap film is made of plastic.

* * * * *